US008141714B2

(12) United States Patent
Burkhard

(10) Patent No.: US 8,141,714 B2
(45) Date of Patent: Mar. 27, 2012

(54) LINEAR MOTORS FOR SHAKER MOTION CONTROL

(75) Inventor: Alan Wayne Burkhard, Fort Thomas, KY (US)

(73) Assignee: M-I LLC, Houston, TX (US)

( * ) Notice: Subject to any disclaimer, the term of this patent is extended or adjusted under 35 U.S.C. 154(b) by 397 days.

(21) Appl. No.: 11/960,470

(22) Filed: Dec. 19, 2007

(65) Prior Publication Data

US 2008/0149539 A1 Jun. 26, 2008

Related U.S. Application Data

(60) Provisional application No. 60/871,223, filed on Dec. 21, 2006.

(51) Int. Cl.
*B07B 1/42* (2006.01)

(52) U.S. Cl. ..... 209/365.1; 209/368

(58) Field of Classification Search .... 209/365.1–365.4, 209/368

See application file for complete search history.

(56) References Cited

U.S. PATENT DOCUMENTS

| | | | | |
|---|---|---|---|---|
| 1,641,435 | A * | 9/1927 | Jacobsen | 198/570 |
| 3,693,549 | A * | 9/1972 | Cuenoud et al. | 198/792 |
| 4,356,911 | A * | 11/1982 | Brown | 198/766 |
| 5,265,730 | A | 11/1993 | Norris et al. | |
| 5,301,815 | A * | 4/1994 | Chauvin et al. | 209/365.4 |
| 5,816,386 | A * | 10/1998 | Carlyle | 198/768 |
| 5,919,358 | A | 7/1999 | Williams | |
| 6,155,428 | A | 12/2000 | Bailey et al. | |
| 6,189,683 | B1 * | 2/2001 | Svejkovsky et al. | 198/769 |
| 6,415,913 | B2 * | 7/2002 | Sleppy et al. | 198/766 |
| 6,513,664 | B1 | 2/2003 | Logan et al. | |
| 6,748,648 | B2 * | 6/2004 | Van De Rijdt | 29/740 |
| 6,827,223 | B2 * | 12/2004 | Colgrove et al. | 209/365.3 |
| 7,399,383 | B2 * | 7/2008 | Giovinazzo | 198/755 |
| 7,472,898 | B2 * | 1/2009 | Kraus | 267/136 |
| 7,571,817 | B2 * | 8/2009 | Scott et al. | 209/413 |
| 2001/0039719 | A1 | 11/2001 | Van De Rijdt | |
| 2006/0243643 | A1 | 11/2006 | Scott et al. | |

OTHER PUBLICATIONS

PCT International Search Report issued in PCT Application No. PCT/US2007/088551 dated Mar. 28, 2008 (3 pages).
PCT Written Opinion issued in PCT Application No. PCT/US2007/088551 dated Mar. 28, 2008 (3 pages).
Examination Report issued in corresponding British Patent Application No. GB0911702.9; Dated Nov. 29, 2010 (2 pages).

* cited by examiner

*Primary Examiner* — Joseph C Rodriguez
(74) *Attorney, Agent, or Firm* — Osha Liang LLP

(57) ABSTRACT

Embodiments relate to a vibratory screen separator and methods for using a vibratory screen separator. The vibratory screen separator may have a stationary base, a movable basket, and at least one linear motor for imparting motion to the movable basket, and methods for using the vibratory screen separator. The linear motor may include a stationary component and a moving component, wherein the moving component is coupled to the movable basket, and wherein the stationary component is coupled to the stationary base. The method may include passing a material including solid particles onto the screen, and moving the basket with at least one linear motor having a movable component coupled to the basket and a stationary component coupled to a base.

17 Claims, 9 Drawing Sheets

LINEAR MOTORS FOR SHAKER MOTION CONTROL

CROSS-REFERENCE TO RELATED APPLICATION

This application claims benefit to U.S. Provisional Application Ser. No. 60/871,223, filed Dec. 21, 2006, the disclosure of which is incorporated herein by reference.

BACKGROUND

1. Field of the Disclosure

Embodiments disclosed herein relate generally to screen separators, and in particular to vibrating screen separators.

2. Background

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to farther remove smaller cuttings.

A plurality of motions has been commonly used for the screening of materials, including linear, round, and elliptical motion. Currently, when a drilling operator chooses a separatory profile, therein selecting a type of motion that actuators of the vibratory separator will provide to the screen assemblies, they typically choose between a profile that either processes drilling material quickly or thoroughly. It is well known in the art that providing linear motion increases the G-forces acting on the drilling material, thereby increasing the speed of conveyance and enabling the vibratory separator to process heavier solids loads. By increasing the speed of conveyance, linear motion vibratory shakers provide increased shaker fluid capacity and increased processing volume. However, in certain separatory operations, the weight of solids may still restrict the speed that linear motion separation provides. Additionally, while increased G-forces enable faster conveyance, as the speed of conveyance increases, there is a potential that the produced drill cuttings may still be saturated in drilling fluid.

Alternatively, a drilling operator may select a vibratory profile that imparts lower force vibrations onto the drilling material, thereby resulting in drier cuttings and increased drilling fluid recovery. However, such lower force vibrations generally slow drilling material processing, thereby increasing the time and cost associated with processing drilling material.

Round motion may be generated by a simple eccentric weight located roughly at the center of gravity of a resiliently mounted screening device with the rotational axis extending perpendicular to the vertical symmetrical plane of the separator. Such motion is considered to be excellent for particle separation and excellent for screen life. It requires a very simple mechanism, a single rotationally driven eccentric weight. However, round motion acts as a very poor conveyor of material and becomes disadvantageous in continuous feed systems where the oversized material is to be continuously removed from the screen surface. Machines are also known with two parallel axes of eccentric rotation extending perpendicular to the symmetrical plane.

Another common motion is achieved through the counter rotation of adjacent eccentric vibrators also affixed to a resiliently mounted screening structure. Through the orientation of the eccentric vibrators at an angle to the screening plane, linear vibration may be achieved at an angle to the screen plane. Such inclined linear motion has been found to be excellent for purposes of conveying material across the screen surface. However, it has been found to be relatively poor for purposes of separation and is very hard on the screens.

Another motion commonly known as multi-direction elliptical motion is induced where a single rotary eccentric vibrator is located at a distance from the center of gravity of the screening device. This generates elliptical motions in the screening device. However, the elliptical motion of any element of the screen has a long axis passing through the axis of the rotary eccentric vibrator. Thus, the motion varies across the screening plane in terms of direction. This motion has been found to produce efficient separation with good screen life. As only one eccentric is employed, the motion is simple to generate. However, such motion is very poor as a conveyor.

U.S. Pat. No. 6,513,664 discloses a vibrating screen separator that may be operated in linear or elliptical modes. The shaker allows operators to use linear motion while drilling top-hole sections where heavy, high-volume solids such as gumbo are usually encountered. In these intervals, shakers need to generate high G-forces to effectively move dense solids across the screens. As conditions change, the shaker can be adjusted from linear to balanced elliptical motion without shutting down the shaker. Operating in the gentler balanced elliptical mode, solids encounter reduced G-forces and longer screen residence time.

Another motion similar to the counter rotation of adjacent eccentric vibrators is illustrated in U.S. Pat. No. 5,265,730. Uni-directional elliptical motion is generated through the placement of two rotary eccentric vibrators with the axes of the vibrators similarly inclined from the vertical away from the direction of material travel and oppositely inclined from the vertical in a plane perpendicular to the direction of material travel. The inclination of the large axis of the elliptical motion relative to the screen surface is controlled by the inclination of the rotary eccentric vibrators away from the intended direction of travel of the material on the screen surface. The inclination of the vibrators in a plane perpendicular to the intended direction of material travel varies the width of the ellipse. These devices have been found to require substantial frame structures to accommodate the opposed forces imposed upon the frame.

In general, the efficiency of the shaker may be influenced by the vibration pattern of the shaker, as described above. The vibratory motions described above are typically imparted to the shaker screen through rotation of at least one unbalanced weight by a rotary motor. Shaker efficiency may also be influenced by the vibration dynamics, or G-force imparted to the particles due to the shaking. Other variables that may influence efficiency include deck size and configuration, shaker processing efficiency, and shaker screen characteristics. The angle of the shaker screen, or deck angle, relative to horizontal may also affect separation efficiency. Deck angle is often controlled hydraulically, and can be automated or manually adjusted.

As described above, control of the vibratory pattern of the shaker, deck angle, and other variables may affect shaker efficiency. Additionally, multiple component parts are used to independently control these variables. The vibrations of the vibrating screen separator, in addition to normal wear and tear, subject these component parts to fatigue and failure.

Accordingly, there exists a need for a shaker having improved control of shaker variables, fewer component parts, and/or improved motion control.

SUMMARY OF DISCLOSURE

In one aspect, embodiments disclosed herein relate to a vibratory screen separator. The screen separator may include a stationary base, a movable basket, and at least one linear motor for imparting motion to the movable basket. The linear motor may include a stationary component and a moving component, wherein the moving component is coupled to the movable basket, and wherein the stationary component is coupled to the stationary base.

In another aspect, embodiments disclosed herein relate to a method of operating a separator, where the separator may include a screen coupled to a basket. The method may include passing a material including solid particles onto the screen, and moving the basket with at least one linear motor having a movable component coupled to the basket and a stationary component coupled to a base.

Other aspects and advantages of the invention will be apparent from the following description and the appended claims.

DETAILED DESCRIPTION

In one aspect, embodiments disclosed herein relate to the use of magnetic forces to impart vibrational movement to a screen separator. In other aspects, embodiments disclosed herein relate to the use of linear motors to impart vibrational movement to a screen separator.

Figure 1:
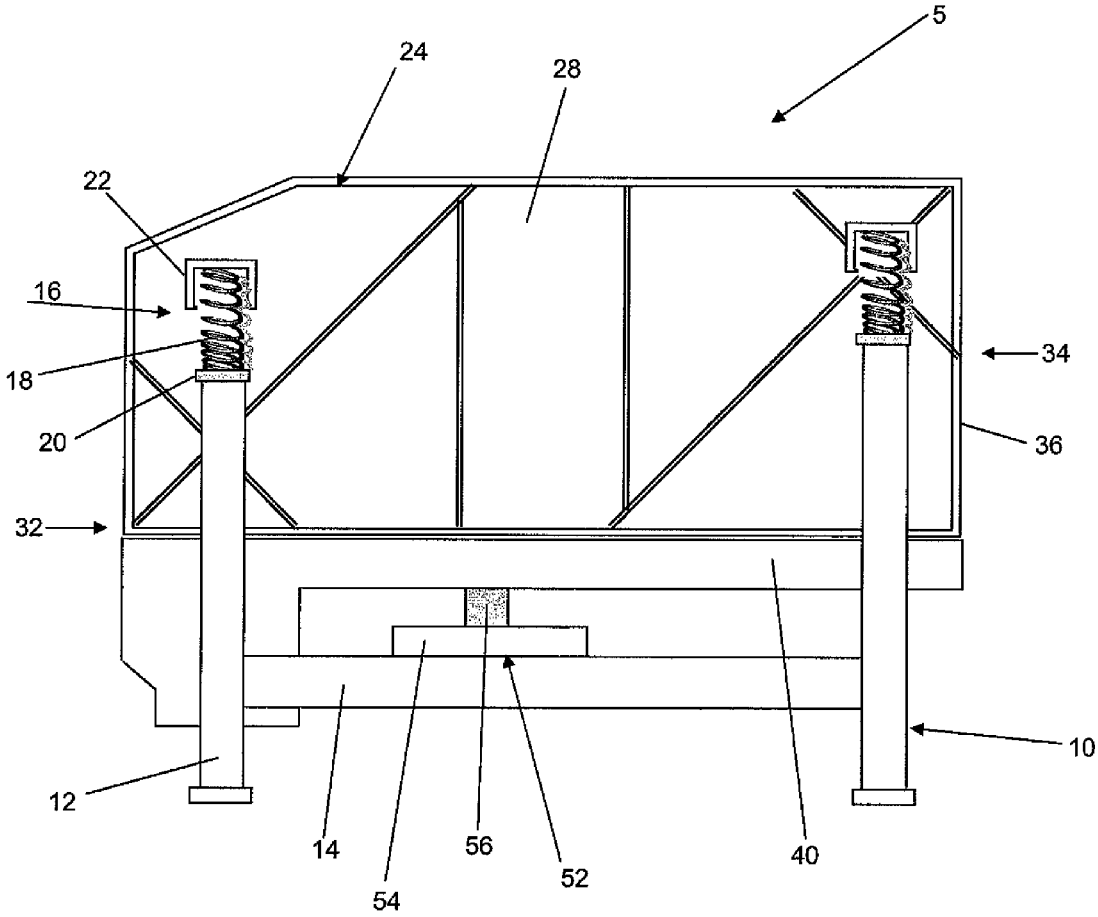
FIG. 1 is a side view of a vibratory screen separator in accordance with embodiments disclosed herein.
Figure 2:
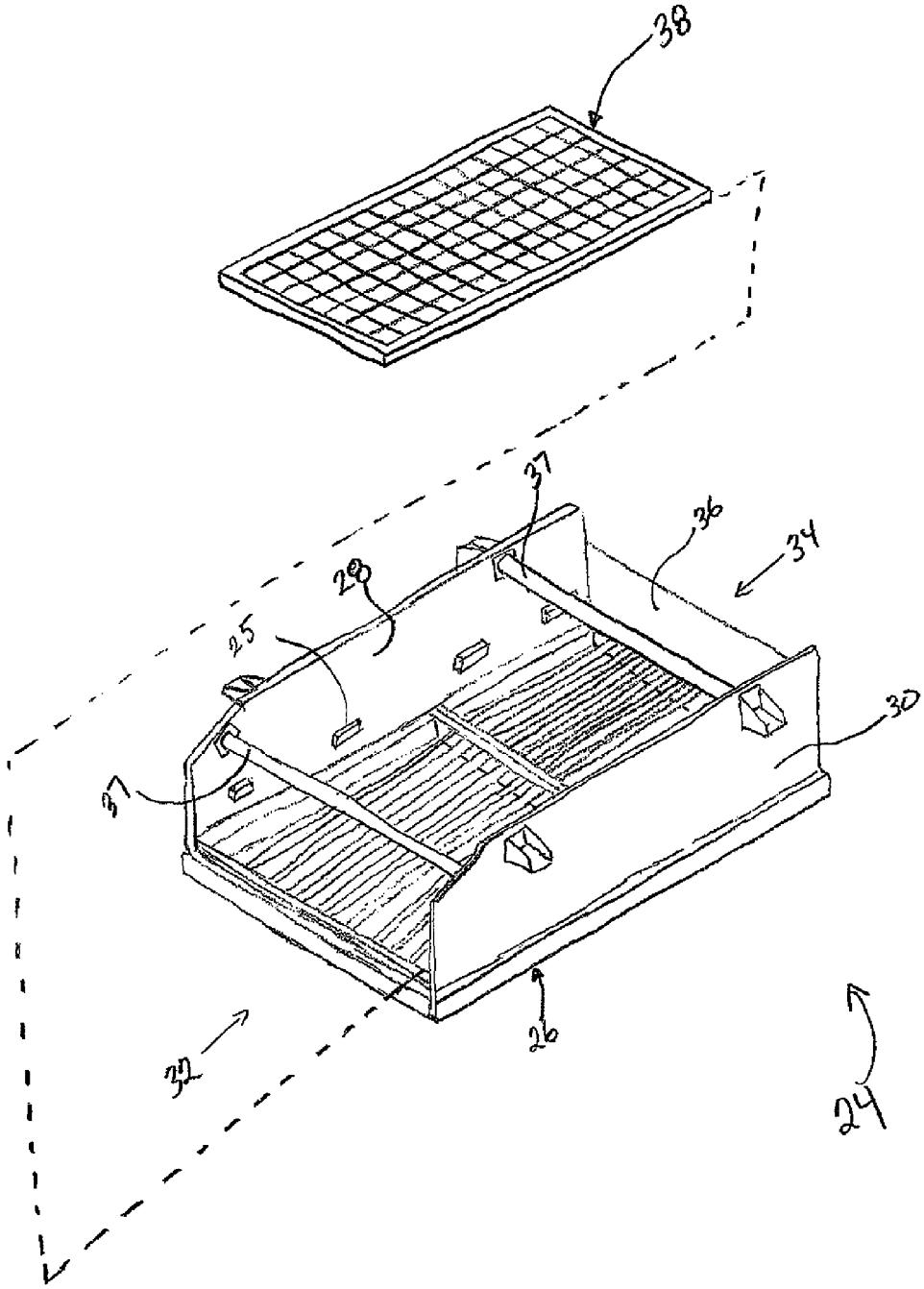
FIG. 2 is an isometric view of a vibratory screen separator basket in accordance with embodiments disclosed herein.

Referring initially to FIGS. 1 and 2, a vibrating screen separator 5 in accordance with embodiments of the present disclosure is shown. Screen separator 5 may include a base 10 including four legs 12 and support members 14. Support members 14 may extend between each of the four legs or between two of the four legs as necessary for support.

Optionally mounted on legs 12 may be resilient mounts 16. Each mount 16 may include a spring 18, a base 20 on each leg 12, and a socket 22 on the separator to receive each spring 18. Positioned on the base 10 adjacent the resilient mounts 16 is a basket 24.

Basket 24 may include a bed frame 26, side walls 28, 30, a discharge end 32, and an inlet end 34. End wall 36 may be located proximate inlet end 34. Basket 24 may also include one or more cross support members 37. One or more screens 38 may be received within the basket 24, and may be rigidly coupled to basket 24 using a screen mounting 25 located along side walls 28, 30 above bed frame 26. Screen mounting 25 may be any type of mounting conventionally known in the art to support a screen within a separator frame, including wedges and wedge guides, hydraulic clamps, and bolts.

Operationally, as a mixture of solids or a mixture of solids and fluids, such as drilling material, for example, enters basket 24 through inlet end 34, the solids are moved along screens 38 by a vibratory motion. As basket 24 vibrates, liquid and smaller particulate matter may fall through screens 38 for collection and recycling, while larger solids are discharged from discharge end 32. A pan 40 may be located below bed frame 26 to receive material passing through screens 38.

In general, for embodiments of the vibratory screen separators disclosed herein, vibratory motion may be imparted to the basket using magnetic forces. For example, a first magnetic component may be coupled to the base, and a second magnetic component may be coupled to the basket proximate the first magnetic component. Vibratory motion may be generated by controlling or varying an attractive force between the first magnetic component and the second magnetic component.

For example, in some embodiments, by cyclically alternating between attractive and repulsive forces, the magnetic components may impart vibratory motion to the basket. The relative strengths of the magnetic fields and the cyclic period between attractive and repulsive forces may be used to control the amount of vibration imparted to the basket. Additionally, the relative placement of the magnetic components may control the direction or angle of the motion.

Vibratory motion may be supplied in some embodiments by one or more linear motors. Linear motors use electromagnetism to controllably vary the position of a movable component with respect to a stationary component. In some embodiments, the linear motors used to impart vibratory motion may include at least one flat linear motor, at least one tubular linear motor, or combinations thereof.

Referring back to FIG. 1, one or more flat linear motors 52 may be used to impart vibratory motion to basket 24. Flat linear motor 52 may include a stationary component 54 coupled to base 10 and a movable component 56 coupled to basket 24. By controlling the position of the movable component 56 relative to stationary component 54, flat linear motor 52 may impart motion to the basket 24.

One or more flat linear motors 52 may be located anywhere on the vibrating screen assembly 5 such that the stationary component may be coupled to the base 10 and the movable component may be coupled to the basket 24 or an integral pan 40. In various embodiments, one or both of the stationary component 54 and movable component 56 may be directly or indirectly coupled to the base 10 and basket 24, respectively. Operation of flat linear motors 52 may require observance of design limitations, such as a required air gap between stationary component 54 and movable component 56. Design, installation, and operation of a vibratory screen separator using a flat linear motor to impart vibratory motion should take into account these linear motor design limitations.

Figure 3:
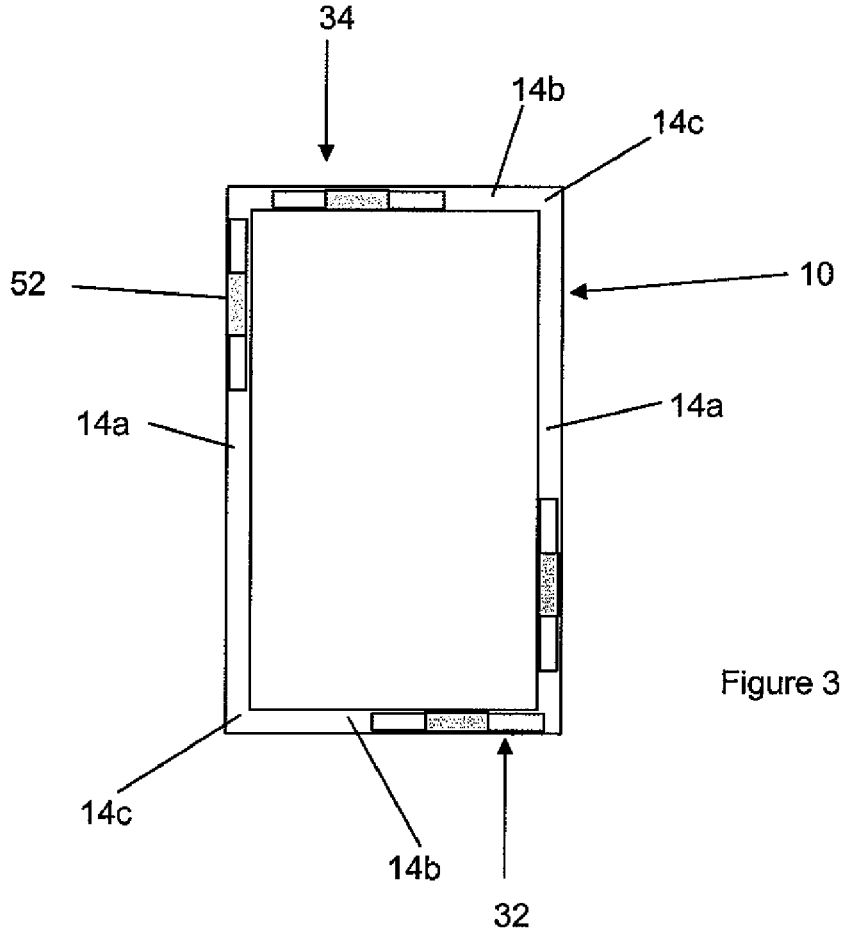
FIG. 3 is a top view of a vibratory screen separator base in accordance with embodiments disclosed herein.

For example, as illustrated in FIG. 1, flat linear motor 52 may be installed on a support member 14, thereby allowing for front-to-back vibration. As illustrated in FIG. 3, one or more flat linear motors 52 may be installed along side rails 14*a*, back rails 14*b*, corners 14*c*, or on other support members (e.g., a cross-member intermediate side rails 14*a* and back rails 14*b*) and may provide for front-to-back motion, side-to-side motion, or a combination thereof. In other embodiments, one or more flat linear motors 52 may be horizontally disposed on legs 12, imparting horizontal motion (front-to-back motion, side-to-side motion, or a combination thereof). In other embodiments, one or more flat linear motors 52 may be vertically disposed on legs 12, rails 14, or other support members, imparting vertical motion to basket 24. In yet other embodiments, one or more flat linear motors may be angularly disposed on legs 12, rails 14 or other support members, imparting motion that is at an angle with respect to both horizontal and vertical.

Figure 4:
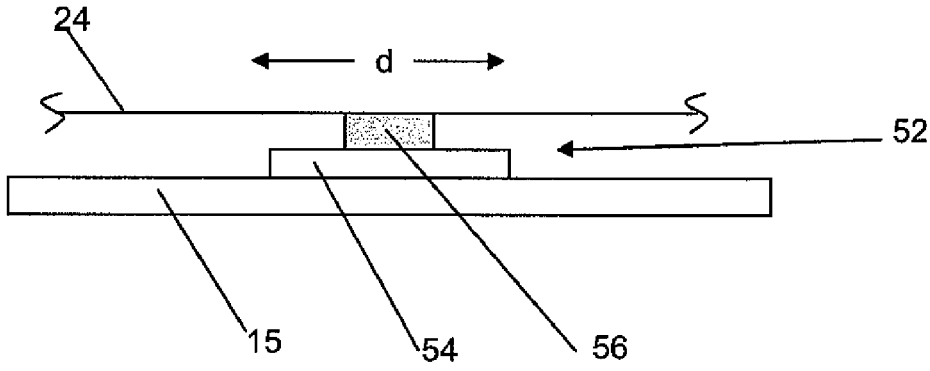
FIG. 4 is a partial side view of a vibratory screen separator in accordance with embodiments disclosed herein.

Now referring to FIGS. 1 and 4 together, in other embodiments, flat linear motor 52 may be installed on support 15, wherein support 15 is static with respect to a direction of travel "d" of the movable component 56. For example, flat linear motor 52 may be installed on support 15 imparting horizontal motion to basket 24. Support 15 may be coupled to legs 12 such that support 15 is horizontally static but may be vertically movable, such as where support 15 is disposed in vertical slots in legs 12, allowing for vertical movement of support 15. In this manner, any vertical vibrational movement v of basket 24 imparted by operation of vibratory screen separator 5 may be dampened with respect to a linear motor 52 mounted on support 15.

Figure 5:
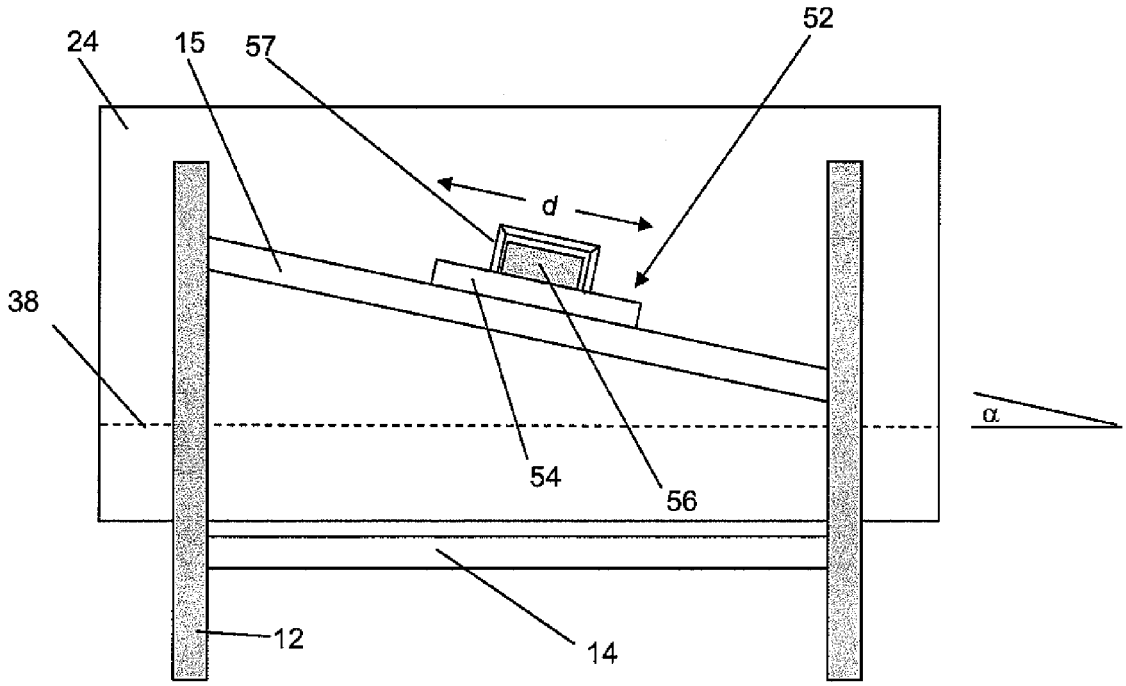
FIG. 5 is a side view of a vibratory screen separator in accordance with embodiments disclosed herein.

Referring now FIG. 5, a rigid or movable support 15, as described above, may be mounted at an incline or a decline in some embodiments. For example, flat linear motor 52 may be coupled to basket 24 via socket 57. In this manner, flat linear motor 52, mounted on angled support 15, may impart vibrational motion that is at an angle $\alpha$ relative to the surface of screens 38 or relative to horizontal. In some embodiments, the vibration angle $\alpha$ may be at a fixed angle from the screen surface. In other embodiments, angled support 15 may be adjustable such that the angle of motion $\alpha$ is variable with respect to screen 38.

In some embodiments, the one or more flat linear motors may be single-axis linear motors (e.g., front-to-back, side-to-side, or up-and-down). In other embodiments, the flat linear motors may be dual-axis linear motors, controlling movement in two perpendicular directions (e.g., front-to-back and side-to-side, front-to-back and up-and-down, or other similar combinations). In other embodiments, two or more single-axis and/or dual-axis linear motors may be used to impart multi-directional vibrational movement. In still other embodiments, one or more flat linear motors 52 may impart balanced or unbalanced elliptical motion.

Figure 6:
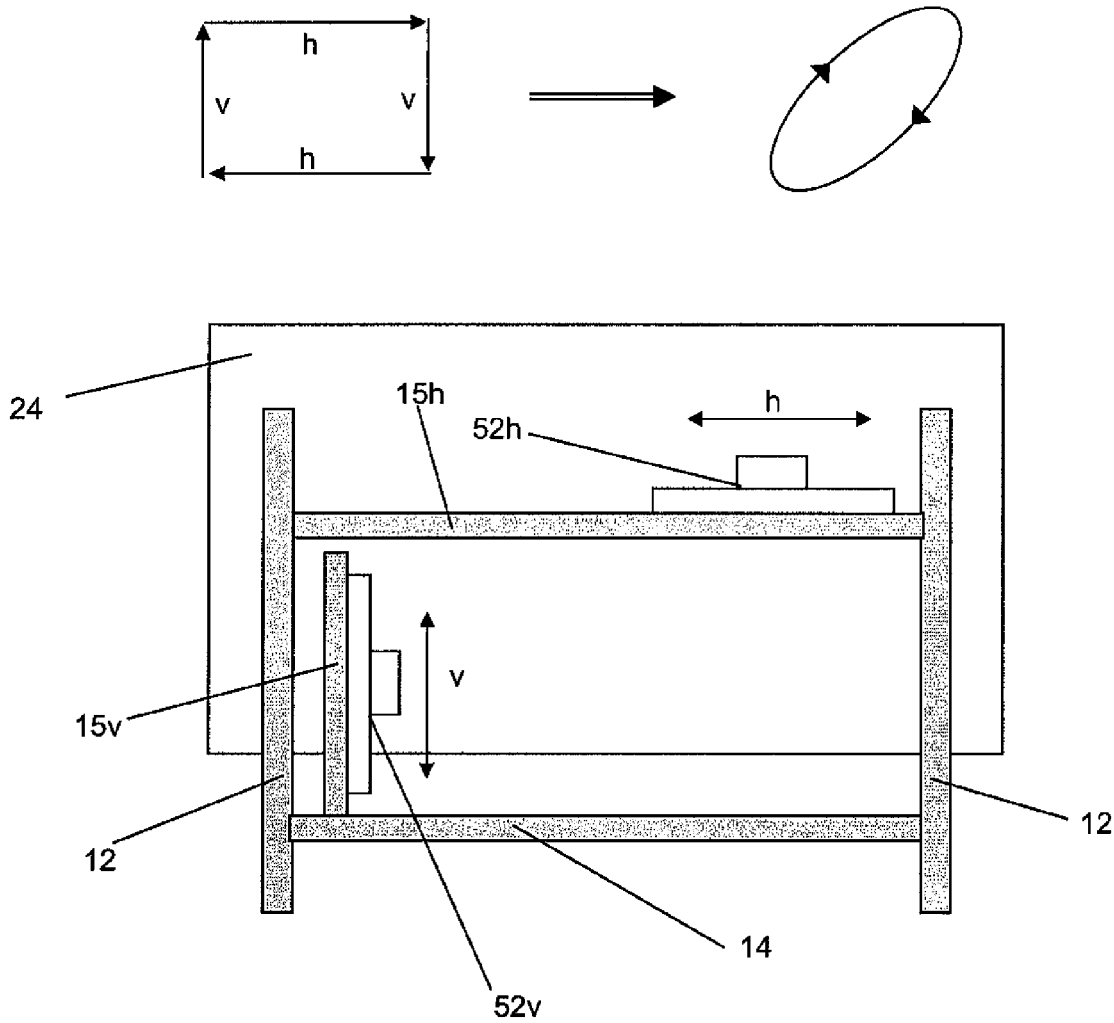
FIG. 6 is a side view of a vibratory screen separator in accordance with embodiments disclosed herein.

For example, elliptical motion may be generated using two linear motors as illustrated in FIG. 6. Flat linear motor 52*h* may impart horizontal motion h to basket 24 where support 15*h* may be rigidly supported horizontally and vertically movable. Flat linear motor 52*v* may impart vertical motion v to basket 24, where support 15*v* may be rigidly supported vertically and horizontally movable. Coordinated movement of linear motors 52*v*, 52*h*, such as where linear motor 52*v* moves vertically upward as 52*h* moves horizontally forward, may provide for elliptical motion of basket 24. A similar elliptical motion may be generated by controllably moving a dual-axis linear motor.

The one or more flat linear motors 52 may have a stroke length ranging from 0.01 inches to 2 feet or more in some embodiments, where stroke length is the unidirectional distance traveled by the movable component with respect to the stationary component before reversing direction. In other embodiments, flat linear motors 52 may have a stroke length ranging from about 0.1 inches to 1 foot or more; and from about 0.25 inches to 0.75 inches in yet other embodiments. One of ordinary skill in the art will appreciate that, in other embodiments, stroke length ranges may include any range capable of conveying drilling material on a vibratory separator.

In certain embodiments, the stroke length may be controlled such that the vibrational movement imparted to basket 24 is controllable. In selected embodiments, the stroke length may be repeatable, such that the end points of each stroke are within a specified variance (e.g., within 10 microns of previous cycles). Repeatable stroke cycles may thereby provide a consistent vibrational pattern to basket 24.

The acceleration of the movable component of the linear motors may be controllable, and thus the vibrational energy imparted to basket 24 may be controllable. Flat linear motors 52 may impart a vibrational energy (G's or g-forces) ranging from 0.1 to 10 G's in some embodiments. In other embodiments, flat linear motors 52 may impart from 0.5 to 8 G's; and from 1 to 6 G's in still other embodiments.

Vibrational energy may also be affected by the velocity at which the movable component travels between end points of each stroke. In some embodiments, the one or more flat linear motors may have a velocity between end points of up to 500 in/sec; up to 400 in/sec in other embodiments; up to 300 in/sec in other embodiments; up to 250 in/sec in other embodiments; up to 200 in/sec in other embodiments; and up to 100 in/sec in yet other embodiments. In other embodiments, the velocity between endpoints may be variable and/or controllable.

The stroke frequency of flat linear motors 52, or number of strokes per minute (where two strokes is equivalent to a vibrational cycle: one stroke forward and one stroke back to the starting point), may range from 1 to 3600 cycles per minute in some embodiments. In other embodiments, the stroke frequency may range from 1 to 1800 cycles per minute; from 1 to 600 cycles per minute in other embodiments; and from 1 to 360 cycles per minute in yet other embodiments.

Figure 7A:
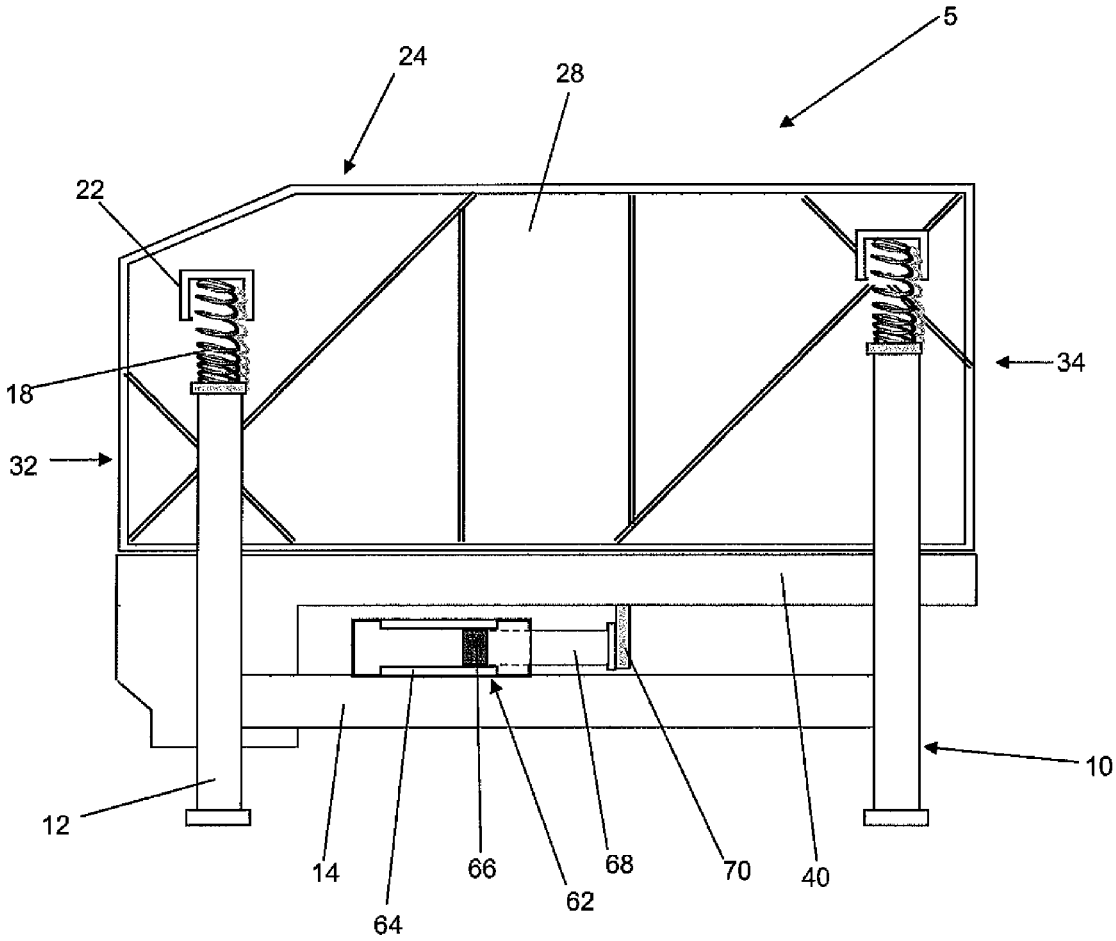
FIG. 7*a* is a side view of a vibratory screen separator in accordance with embodiments disclosed herein.

Referring now to FIG. 7*a*, a vibrating screen separator 5 in accordance with embodiments of the present disclosure is shown, where like numerals represent like parts. One or more tubular linear motors 62 may be used to impart vibration to basket 24. Tubular linear motor 62 may include a stationary component 64 coupled to rail 14 of base 10, and a movable component 66 directly or indirectly coupled to basket 24 via piston 68 and socket 70. By controlling the position of the movable component 66 relative to stationary component 64, tubular linear motor 62 may impart motion to basket 24.

Similar to flat linear motors described above, one or more tubular linear motors 62 may be located anywhere on the vibrating screen assembly 5. Operation of tubular linear motors 62 may require observance of design limitations, such as a required air gap between stationary component 64 and movable component 66. Design, installation, and operation of a vibratory screen separator using a tubular linear motor 62 to impart vibratory motion should take into account these linear motor design limitations.

Figure 7B:
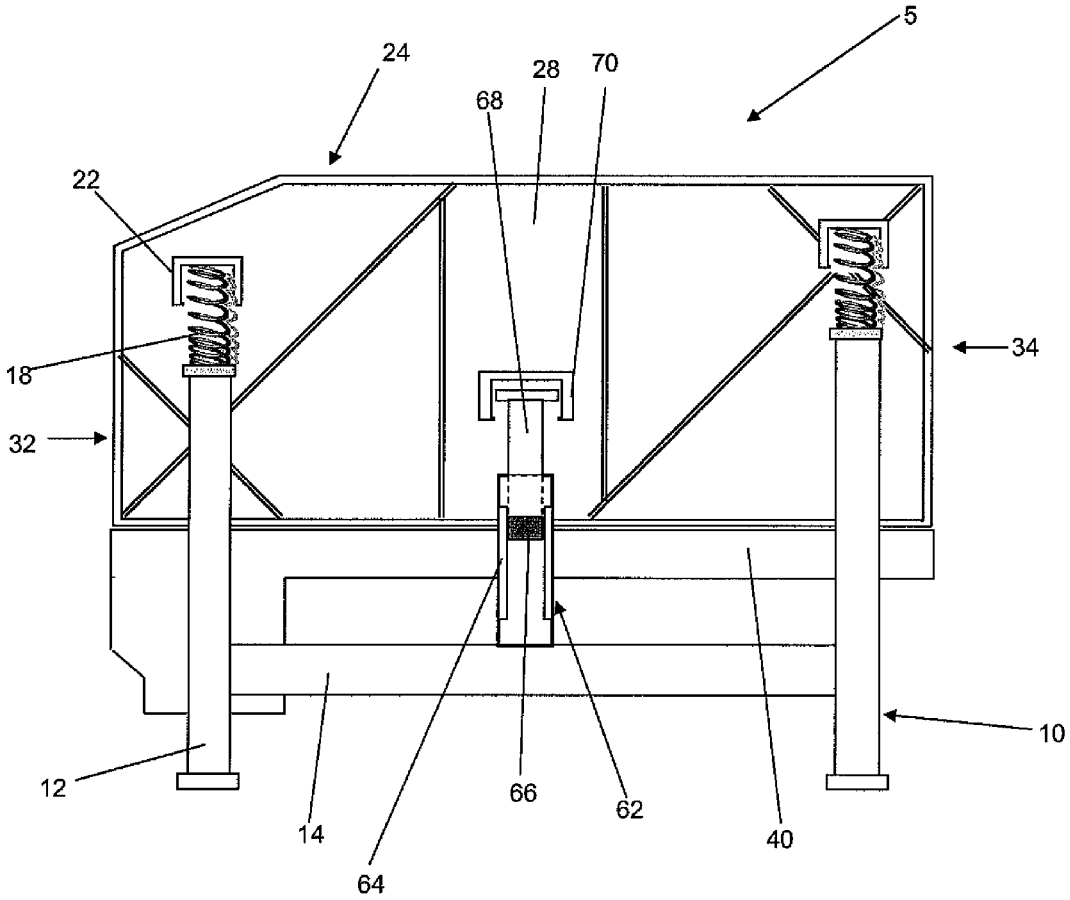
FIG. 7*b* is a side view of a vibratory screen separator in accordance with embodiments disclosed herein.
Figure 8:
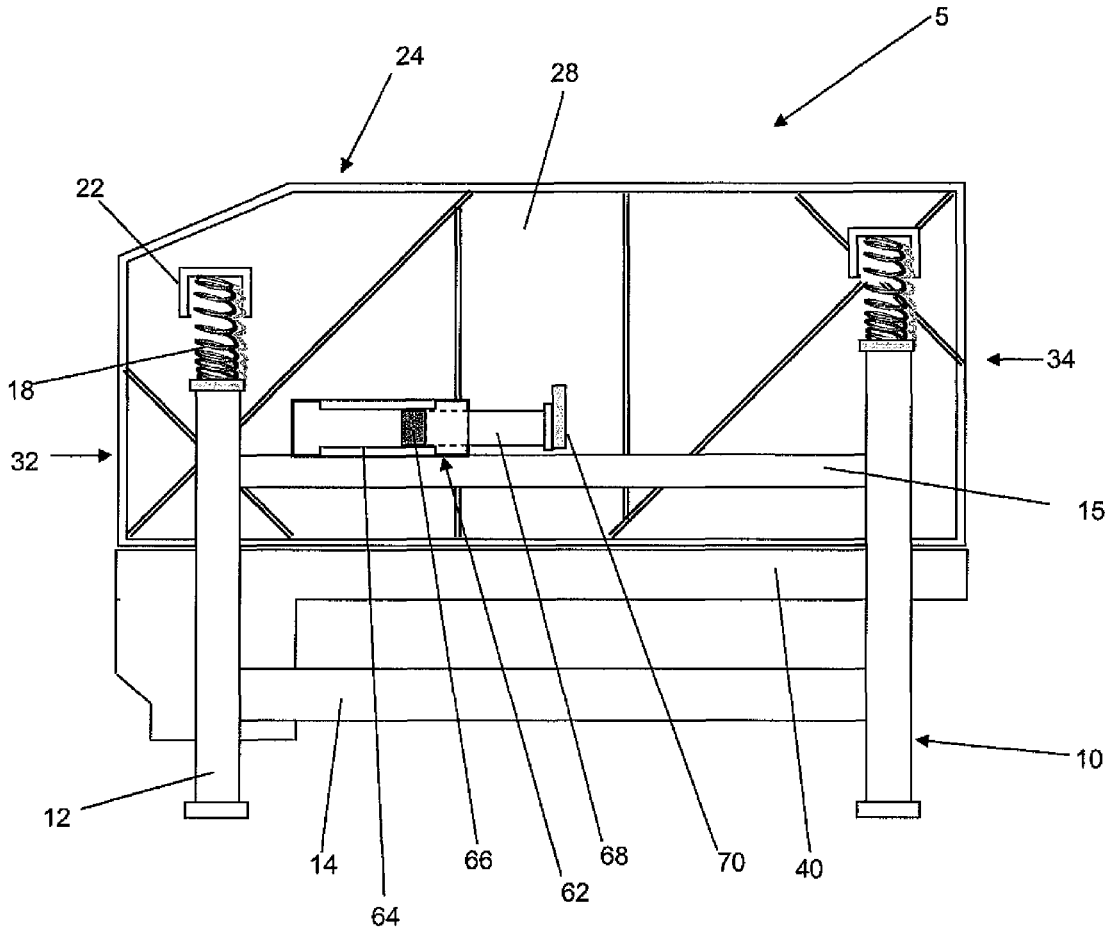
FIG. 8 is a side view of a vibratory screen separator in accordance with embodiments disclosed herein.

As illustrated in FIG. 7*a*, one or more tubular linear motors 62 may be coupled horizontally to a support member 14, imparting horizontal motion to basket 24. As illustrated in FIG. 7*b*, one or more tubular linear motors 62 may be disposed vertically, imparting vertical motion to basket 24. Similar to the flat linear motors described above and with respect to FIG. 3, tubular linear motors 62 may be installed along side rails 14*a*, back rails 14*b*, corners 14*c*, or on another support member (e.g. a cross-member intermediate side rails 14*a* and back rails 14*b*) and may impart front-to-back motion, side-to-side motion, or a combination thereof. In other embodiments, one or more tubular linear motors 62 may be horizontally disposed on legs 12, imparting horizontal motion (front-to-back motion, side-to-side motion, or a combination thereof). In other embodiments, one or more tubular linear motors 62 may be vertically disposed on legs 12, rails 14, or other support members, imparting vertical motion to basket 24. In yet other embodiments, one or more tubular linear motors may be angularly disposed on legs 12, rails 14 or other support members, imparting motion that is at an angle with respect to both horizontal and vertical. In other embodiments, and with reference to FIG. 8, tubular linear motors 62 (similar to flat linear motor 52 as illustrated in FIG. 5) may be installed on a support 15, where support 15 may be static with respect to the direction of travel "d" of the movable component 66.

Figure 9:
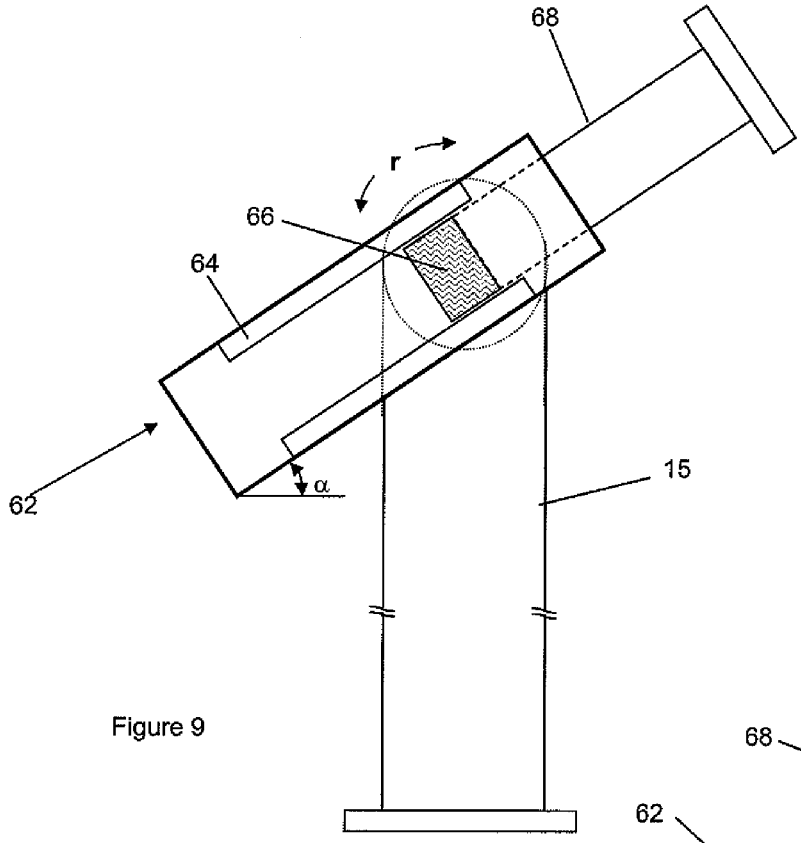
FIG. 9 is a tubular linear motor useful in embodiments of a vibratory screen separator in accordance with embodiments disclosed herein.

As illustrated in FIG. 9, in some embodiments, tubular linear motor 62 may be mounted at an incline or a decline such that a tubular linear motor 62 may impart vibrational motion that is at an angle $\alpha$ relative to the surface of screens (not shown) or relative to horizontal. In some embodiments, the vibration angle $\alpha$ may be at a fixed angle from the screen surface. In other embodiments, tubular linear motor 62 may be radially adjustable r with respect to support 15 such that the angle of motion $\alpha$ is variable with respect to the screens or relative to horizontal. In other embodiments, the direct or indirect coupling of flat or tubular linear motors to the basket may be adjustable such that the angle of motion is variable with respect to the screens or relative to horizontal.

As described above with respect to FIGS. 1-10, one or more tubular linear motors 62 may be used to impart linear motion, multi-directional linear motion, balanced elliptical motion, or unbalanced elliptical motion. In certain embodiments, one or more tubular motors may be used in conjunction with one or more flat linear motors to impart linear motion, multi-directional linear motion, balanced elliptical motion, or unbalanced elliptical motion.

The one or more tubular linear motors 62 may have a stroke length ranging from 0.01 inches to 2 feet or more in some embodiments, where stroke length is the unidirectional distance traveled by the movable component with respect to the stationary component before reversing direction. In other embodiments, tubular linear motors 62 may have a stroke length ranging from about 0.1 inches to 1 foot or more; and from about 0.25 inches to 0.75 inches in yet other embodiments.

In certain embodiments, the stroke length of tubular linear motors 62 may be variable (controllable) such that the vibrational movement imparted to basket 24 is controllable. In selected embodiments, the stroke length may be repeatable, such that the end points of each stroke are within 10 microns of previous cycles; within 5 microns in other embodiments; within 1 micron in yet other embodiments. Repeatable stroke cycles may provide a consistent vibrational pattern to basket 24.

The acceleration of the movable component of tubular linear motors 62 may be controllable, and thus the vibrational energy imparted to basket 24 may be controllable. Tubular linear motors 62 may impart a vibrational energy (G's or g-forces) ranging from 0.1 to 10 G's in some embodiments. In other embodiments, tubular linear motors 62 may impart from 0.5 to 8 G's; and from 1 to 6 G's in yet other embodiments.

Vibrational energy may also be affected by the velocity at which the movable component travels between end points of each stroke. In some embodiments, tubular linear motors may have a velocity between end points of up to 500 in/sec; up to 400 in/sec in other embodiments; up to 300 in/sec in other embodiments; up to 250 in/sec in other embodiments; up to 200 in/sec in other embodiments; and up to 100 in/sec in yet other embodiments. In other embodiments, the velocity between endpoints may be variable and/or controllable.

The stroke frequency of tubular linear motors 62, or number of strokes per minute (where two strokes is equivalent to a vibrational cycle: one stroke forward and one stroke back to the starting point), may range from 1 to 3600 cycles per minute in some embodiments. In other embodiments, the stroke frequency may range from 1 to 1800 cycles per minute; from 1 to 600 cycles per minute in other embodiments; and from 1 to 360 cycles per minute in yet other embodiments.

As described above, flat linear motors and tubular linear motors may be used in conjunction with the optional springs 16 and sockets 22 movably coupling basket 24 to legs 12 of base 10. In some embodiments, one or more tubular motors 62 may be used to movably couple basket 24 and base 10 without springs 16. For example, flat or tubular linear motors may be disposed on base 10 (legs 12 and/or supports 14), where the linear motor(s) both support the weight of basket 24 and impart motion to basket 24.

As another example, stationary component 64 may be disposed on or within legs 12, replacing springs 16. Movable component 66 may be coupled to basket 24, such as coupled to socket 22. In this manner, a tubular linear motor 62 may impart vertical motion to basket 24.

Figure 10:
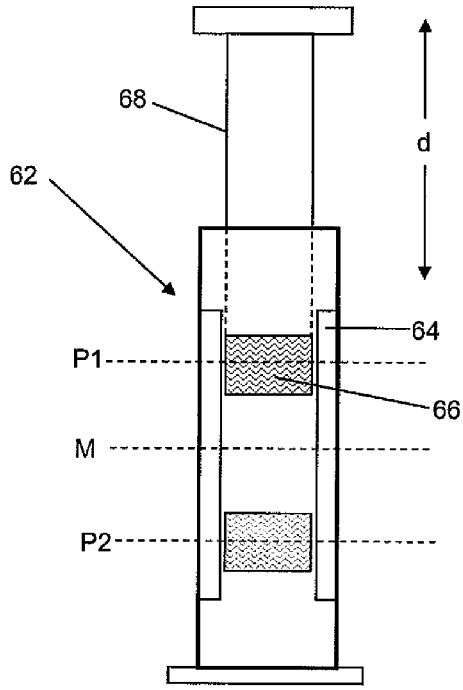
FIG. 10 is a tubular linear motor useful in embodiments of a vibratory screen separator in accordance with embodiments disclosed herein.

Additionally, tubular linear motors that may be used to replace front springs 16 and/or back springs 16 may also be used to control the deck angle of screens disposed in basket 24. For example, as illustrated in FIG. 10, the relative position around which movable component 66 oscillates may be adjusted from a position P1 to a position P2, thus adjusting the deck angle.

In some embodiments, the deck angle may be substantially horizontal when movable component 66 is positioned at a midpoint M of stationary component 64. In this manner, the deck angle may be adjusted to both positive and negative deck angles.

In other embodiments, the deck angle may be substantially horizontal when movable component 66 is positioned above or below a midpoint M of stationary component 64. In this manner, for similar sized tubular linear motors, whereas the range of deck angle adjustment may be equivalent, the positive range may be greater or less than the negative range.

Referring back to FIG. 9, in some embodiments, stationary component 64 may be mounted on leg 12 or base 10 to provide both motion and deck angle adjustment. For example, in some embodiments, the direction of travel of movable component 66 may be at an angle relative to vertical. In this manner, tubular linear motors 62 may impart vibrational motion that is at an angle relative to the surface of screens 38 or relative to vertical. In some embodiments, the vibration angle may be at a fixed angle from the screen surface; in other embodiments, the vibration angle may be at a variable angle with respect to the screen surface. As described above, by varying the relative position around which movable component 66 oscillates, tubular linear motors mounted to legs 12 or within legs 12, may be used to control deck angle and basket motion. Similarly, flat linear motors disposed at an angle from horizontal may also be used to control deck angle and/or vibrational motion.

In various embodiments, a controller, such as a variable frequency drive (VFD) and/or a programmable logic controller (PLC) may be used to control the movement of the movable component. For example, a VFD or PLC may be used to control the stroke length, stroke velocity or other linear motor variables to control the vibrational pattern of the shaker. As another example, a VFD or PLC may be used to vary the position around which the movable component oscillates, thereby controlling deck angle. If four motors were used to replace all the springs, as described above, you may have the ability to completely control the motion of the bed. The ability to run at variable speeds and oscillatory positions may allow for the controlled separation of cuttings, allowing an operator to optimize the separation dependent upon the type and rate of cuttings.

In some embodiments, tubular linear motors may include moving coil-type tubular linear motors. In other embodiments, tubular linear motors may include moving magnet type tubular linear motors.

In some embodiments, the stroke velocity and/or the stroke length of the flat or tubular linear motors may be adjustable or controllable, thereby allowing for independent control of both the amplitude and frequency of the vibrational movement. Additionally, where the angle of motion (linear motor movement direction) is adjustable, one or more of amplitude, frequency, and direction of movement may be controlled or adjusted. In these manners, the motion may be suitably controlled for the particular solids being separated.

Advantageously, embodiments contemplated herein may use tubular linear motors, flat linear motors, and combinations thereof to provide for operation of a vibrating separator. The use of motors disclosed herein may provide for a non-contact operation to control vibrational motion, thereby reducing component wear and reducing maintenance. Additionally, embodiments disclosed herein may provide for controllable, adjustable, and repeatable performance with respect to vibrational force (acceleration), vibrational frequency (stroke velocity), and vibrational amplitude (stroke length).

While the present disclosure has been described with respect to a limited number of embodiments, those skilled in the art, having benefit of this disclosure, will appreciate that other embodiments can be devised which do not depart from the scope of the disclosure as described herein. Accordingly, the scope of the disclosure should be limited only by the attached claims.

What is claimed:

1. A vibratory screen separator, comprising:

a stationary base;

a movable basket positioned above the stationary base; and at least one electromagnetic linear motor for imparting motion to the movable basket, the at least one electromagnetic linear motor comprising a stationary component coupled to the stationary base and a moving component coupled to the movable basket;

wherein the moving component is configured to translate in a linear direction along and within a length of the stationary component.

2. The vibratory screen separator of claim 1, wherein the at least one linear motor is selected from the group consisting of flat linear motors and tubular linear motors, and combinations thereof.

3. The vibratory screen separator of claim 1, wherein the at least one linear motor imparts at least one of vertical, horizontal, linear, round, and elliptical motion to the basket.

4. The vibratory screen separator of claim 3, further comprising a controller to control the motion of the basket.

5. The vibratory screen separator of claim 4, wherein the controller is a programmable logic controller.

6. The vibratory screen separator of claim 4, wherein the controller is a variable frequency drive.

7. The vibratory screen separator of claim 1, wherein the at least one linear motor is used to adjust a deck angle of a screen disposed in the movable basket.

8. The vibratory screen separator of claim 1, wherein the at least one linear motor is selected from the group consisting of single-axis linear motors and dual-axis linear motors, or combinations thereof.

9. The vibratory screen separator of claim 1, wherein at least one of amplitude of vibrational motion, frequency of vibrational motion, and direction of vibrational motion of the linear motor is variable.

10. The vibratory screen separator of claim 1, further comprising a controller to control a position of the movable component relative to the position of the stationary component.

11. The vibratory screen separator of claim 10, wherein the controller varies at least one of displacement distance, displacement frequency, acceleration, and velocity of the moving component.

12. A method of operating a separator, comprising:

passing a material including solid particles onto a screen coupled to a basket positioned above a stationary base;

moving the basket with at least one electromagnetic linear motor comprising a movable component coupled to the basket and a stationary component coupled to the stationary base;

wherein the movable component is configured to translate in a linear direction along and within a length of the stationary component.

13. The method of claim 12, wherein the at least one linear motor moves the basket in a linear, round, or elliptical motion.

14. The method of claim 12, comprising varying a deck angle of the screen with at least one of the linear motors.

15. The method of claim 12, comprising varying at least one of displacement distance, displacement frequency, acceleration, and velocity of the moving component.

16. The method of claim 12, further comprising:

controlling the at least one linear motor with a programmable logic controller.

17. The method of claim 12, further comprising:

controlling the at least one linear motor with a variable frequency drive.

* * * * *